US006535699B1

(12) United States Patent
Abe et al.

(10) Patent No.: US 6,535,699 B1
(45) Date of Patent: Mar. 18, 2003

(54) DEVELOPER CONTAINER, DEVELOPER AMOUNT DETECTING SYSTEM, PROCESS CARTRIDGE, DEVELOPING DEVICE, AND IMAGE FORMING APPARATUS

(75) Inventors: Daisuke Abe, Shizuoka-ken; Tadayuki Tsuda, Susono; Kazuo Chadani, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/824,023

(22) Filed: Apr. 3, 2001

(30) Foreign Application Priority Data

Apr. 7, 2000 (JP) ..... 2000-107240

(51) Int. Cl.[7] ..... G03G 15/00; G03G 15/08
(52) U.S. Cl. ..... 399/27; 399/119
(58) Field of Search ..... 399/27, 29, 30, 399/111, 119

(56) References Cited

U.S. PATENT DOCUMENTS

| | | | |
|---|---|---|---|
| 5,126,800 A | 6/1992 | Shishido et al. | 355/211 |
| 5,151,734 A | 9/1992 | Tsuda et al. | 355/200 |
| 5,208,634 A | 5/1993 | Ikemoto et al. | 355/215 |
| 5,223,893 A | 6/1993 | Ikemoto et al. | 355/200 |
| 5,294,960 A | 3/1994 | Nomura et al. | 355/210 |
| 5,331,372 A | 7/1994 | Tsuda et al. | 355/200 |

(List continued on next page.)

FOREIGN PATENT DOCUMENTS

| | | |
|---|---|---|
| JP | 2000-122397 | 4/2000 |
| JP | 2000-122398 | 4/2000 |

*Primary Examiner*—Fred L Braun
(74) *Attorney, Agent, or Firm*—Fitzpatrick, Cella, Harper & Scinto

(57) ABSTRACT

A developer container for containing a developer includes: (a) a first detecting member which is an electrode member having a pair of input-side and output-side electrodes formed in parallel and in one plane at a predetermined interval for detecting capacitance between the electrodes and which has a measurement-side electrode that is in contact with the developer and a reference electrode that is out of contact with the developer; (b) a developer removing member for removing any developer adhering to a detection region of the first detecting member; and (c) a second detecting member formed of a conductive material for detecting capacitance between the second detecting member and a developer bearing member, wherein a main body of an electrophotographic image forming apparatus first detects the developer amount partway from the start of use of the developer container on the basis of detection information from the first detecting member, and then detects the developer amount on the basis of detection information from the second detecting member.

17 Claims, 14 Drawing Sheets

U.S. PATENT DOCUMENTS

| | | | | |
|---|---|---|---|---|
| 5,345,294 | A | | 9/1994 | Nomura et al. ..... 355/200 |
| 5,404,198 | A | | 4/1995 | Noda et al. ..... 355/200 |
| 5,470,635 | A | | 11/1995 | Shirai et al. ..... 438/131 |
| 5,475,470 | A | | 12/1995 | Sasago et al. ..... 355/210 |
| 5,488,459 | A | | 1/1996 | Tsuda et al. ..... 355/211 |
| 5,510,878 | A | | 4/1996 | Noda et al. ..... 355/211 |
| 5,561,504 | A | | 10/1996 | Watanabe et al. ..... 355/215 |
| 5,581,325 | A | | 12/1996 | Tsuda et al. ..... 355/200 |
| 5,583,613 | A | | 12/1996 | Kobayashi et al. ..... 355/200 |
| 5,602,623 | A | | 2/1997 | Nishibata et al. ..... 399/111 |
| 5,608,509 | A | | 3/1997 | Shirai et al. ..... 399/351 |
| 5,623,328 | A | | 4/1997 | Tsuda et al. ..... 399/111 |
| 5,659,847 | A | | 8/1997 | Tsuda et al. ..... 399/113 |
| 5,669,042 | A | | 9/1997 | Kobayashi et al. ..... 399/111 |
| 5,809,374 | A | | 9/1998 | Tsuda et al. ..... 399/111 |
| 5,812,909 | A | | 9/1998 | Oguma et al. ..... 399/103 |
| 5,828,928 | A | | 10/1998 | Sasago et al. ..... 399/111 |
| 5,878,304 | A | | 3/1999 | Watanabe et al. ..... 399/92 |
| 5,923,918 | A | | 7/1999 | Nakagawa et al. ..... 399/27 |
| 5,943,529 | A | | 8/1999 | Miyabe et al. ..... 399/111 |
| 5,966,567 | A | | 10/1999 | Matsuzaki et al. ..... 399/111 |
| 5,987,269 | A | * | 11/1999 | Allen et al. ..... 399/27 |
| 6,006,058 | A | | 12/1999 | Watanabe et al. ..... 399/167 |
| 6,011,941 | A | | 1/2000 | Takashima et al. ..... 399/111 |
| 6,041,196 | A | | 3/2000 | Nakagawa ..... 399/27 |
| 6,058,278 | A | | 5/2000 | Tsuda et al. ..... 399/106 |
| 6,075,956 | A | | 6/2000 | Watanabe et al. ..... 399/92 |
| 6,097,906 | A | | 8/2000 | Matsuzaki et al. ..... 399/90 |
| 6,144,815 | A | | 11/2000 | Chadani et al. ..... 399/27 |
| 6,154,623 | A | | 11/2000 | Suzuki et al. ..... 399/111 |
| 6,173,140 | B1 | | 1/2001 | Suzuki et al. ..... 399/113 |
| 6,173,145 | B1 | | 1/2001 | Chadani et al. ..... 399/265 |
| 6,178,302 | B1 | | 1/2001 | Nagashima et al. ..... 399/106 |
| 6,205,305 | B1 | | 3/2001 | Suzuki et al. ..... 399/106 |
| 6,219,504 | B1 | | 4/2001 | Matsuzaki et al. ..... 399/92 |
| 6,253,036 | B1 | * | 6/2001 | Karakama et al. ..... 399/27 |
| 6,282,384 | B1 | * | 8/2001 | Saito et al. ..... 399/27 |
| 6,343,193 | B1 | * | 1/2002 | Matsumoto et al. ..... 399/27 |
| 6,347,198 | B1 | * | 2/2002 | Yamamoto et al. ..... 399/27 |
| 6,349,184 | B2 | * | 2/2002 | Otomo ..... 399/27 |
| 6,397,017 | B1 | * | 5/2002 | Sakai et al. ..... 399/27 |

* cited by examiner

DEVELOPER CONTAINER, DEVELOPER AMOUNT DETECTING SYSTEM, PROCESS CARTRIDGE, DEVELOPING DEVICE, AND IMAGE FORMING APPARATUS

BACKGROUND OF THE INVENTION

1. Field of the Invention

The present invention relates to an electrophotographic image forming apparatus. Further, the present invention relates to a process cartridge, a developing device, a developer amount detecting system, and a developer container.

Examples of the electrophotographic image forming apparatus include an electrophotographic copying machine, an electrophotographic printer (such as an LED printer and a laser beam printer), and an electrophotographic facsimile apparatus. A process cartridge is formed by combining at least one of charging means, developing means, and cleaning means with an electrophotographic photosensitive member to compose an integral unit in the form of a cartridge that is detachably mountable to the main body of an electrophotographic image forming apparatus, or is formed by combining at least developing means with an electrophotographic photosensitive member to compose an integral unit in the form of a cartridge that is detachably mountable to the main body of an electrophotographic image forming apparatus.

2. Related Background Art

Conventionally, in electrophotographic image forming apparatuses using the electrophotographic image forming process, a process cartridge system has been widely adopted, in which an electrophotographic photosensitive member and process means acting thereon are combined into an integral unit in the form of a cartridge, which is detachably mountable to the main body of the image forming apparatus. In such a process-cartridge-type electrophotographic image forming apparatus, the user can replace the cartridge in person. In view of this, in some electrophotographic image forming apparatuses of this type, there is provided means for informing the user of consumption of the developer.

In a conventional developer amount detecting device, two electrode bars are provided inside the developer container of developing means, and a variation in capacitance between the two electrode bars is detected to thereby detect whether there is any developer in the container. Japanese Patent Application Laid-Open No. 5-100571 discloses a developer amount detecting device which includes, instead of two electrode bars, a developer detecting electrode member having two parallel electrodes which are arranged in parallel in the same plane at a predetermined interval and interdigitated with each other in a protrusion-and-recess-like fashion, the developer detecting electrode member being installed on the lower surface of the developer container. In this device, a variation in capacitance between the parallel electrodes arranged in a planar fashion is detected to thereby detect whether there is any developer in the container.

If it is possible to successively detect the remaining amount of developer in the developer container, the user will be advantageously enabled to see to what extent the developer has been consumed.

SUMMARY OF THE INVENTION

It is an object of the present invention to provide a developer container, a developing device, a process cartridge, a developer amount detecting system, and an electrophotographic image forming apparatus in which it is possible to successively detect the remaining amount of developer.

Another object of the present invention is to provide a developer container, a developing device, a process cartridge, a developer amount detecting system, and an electrophotographic image forming apparatus in which it is possible to successively detect the remaining amount of developer with high accuracy.

Still another object of the present invention is to provide a developer container, a developing device, a process cartridge, a developer amount detecting system, and an electrophotographic image forming apparatus in which it is possible to successively detect the remaining amount of developer in a stable manner.

A further object of the present invention is to provide a developer container, a developing device, a process cartridge, a developer amount detecting system, and an electrophotographic image forming apparatus in which it is possible to successively detect the remaining amount of developer at low cost.

A further object of the present invention is to provide an electrophotographic image forming apparatus, a process cartridge, a developing device, a developer amount detecting system, and a developer container which are provided with a low-cost, high-accuracy developer amount detecting means, which makes it possible to obtain a stable detection value as the developer in the developer container is consumed and to measure the remaining amount thereof with high accuracy.

A further object of the present invention is to provide a developer container, a developing device, a process cartridge, a developer amount detecting system, and an electrophotographic image forming apparatus comprising:

(a) a first detecting member which is an electrode member having input-side and output-side electrodes formed in parallel in the same plane at a predetermined interval and adapted to detect the capacitance between the electrodes and which has a measurement-side electrode that is in contact with developer and a reference electrode that is out of contact with developer;

(b) a developer removing member for removing developer adhering to a detection region of the first detecting member; and (c) a second detecting member consisting of a conductive member and adapted to detect capacitance between it and a developer bearing member, wherein the first detecting member detects the developer amount partway from the start of use of the developer container, and then the second detecting member detects the developer amount.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

An electrophotographic image forming apparatus, a process cartridge, a developing device, a developer amount detecting system, and a developer container according to the present invention will now be described in detail with reference to the drawings.

First Embodiment (Description of Process Cartridge and Image Forming Apparatus Main Body)

A process cartridge and an electrophotographic image forming apparatus according to the present invention will now be described in detail with reference to the drawings.

Figure 1:
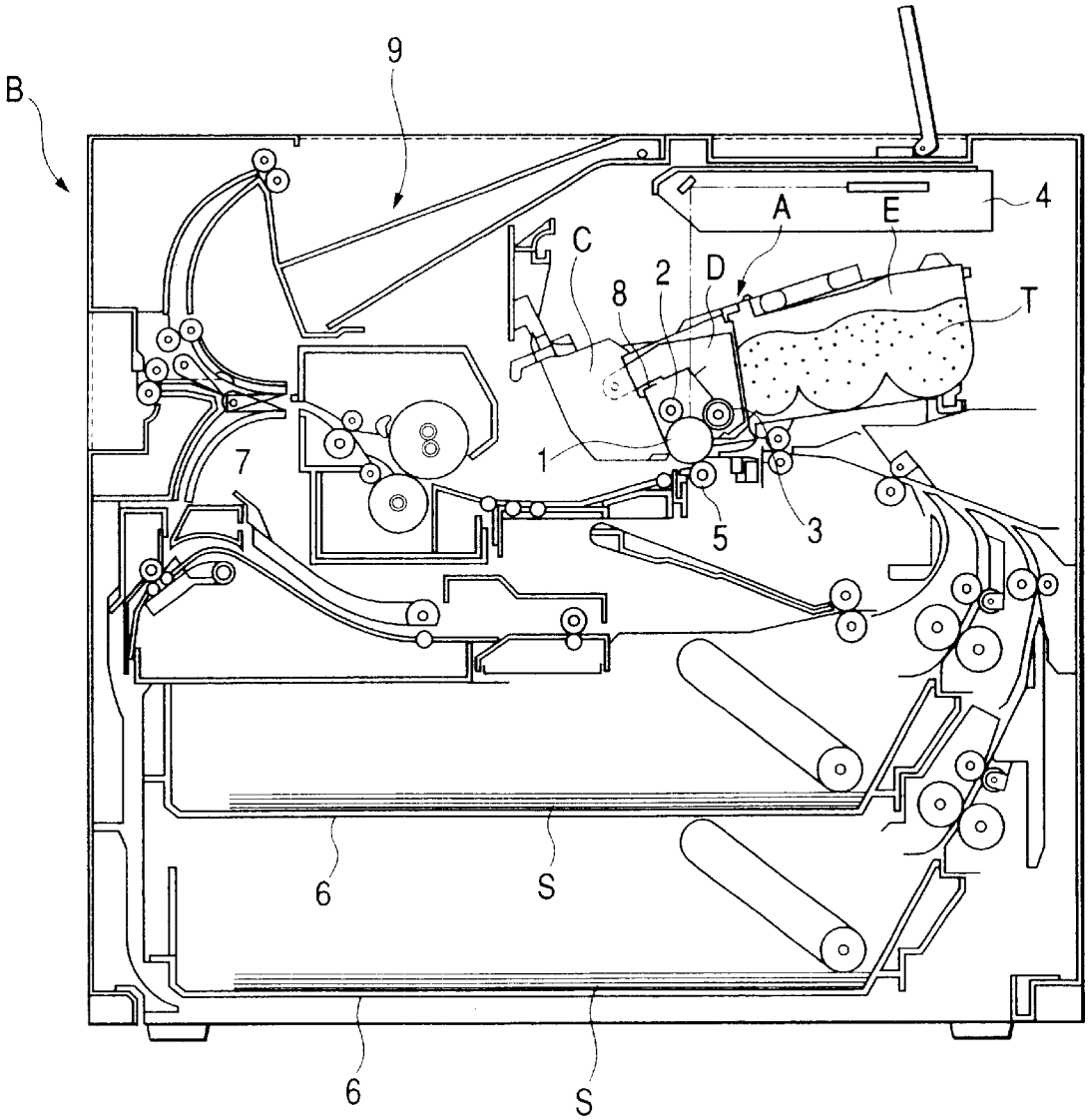
FIG. 1 is a schematic sectional view showing the construction of an electrophotographic image forming apparatus according to the present invention.

First, with reference to FIG. 1, an embodiment of an electrophotographic image forming apparatus to which a process cartridge A constructed according to the present invention can be attached will be described. In this embodiment, the electrophotographic image forming apparatus is an electrophotographic laser beam printer B, which forms images on recording mediums, such as recording paper, OHP sheets, or cloth, by the electrophotographic image forming process.

Figure 2:
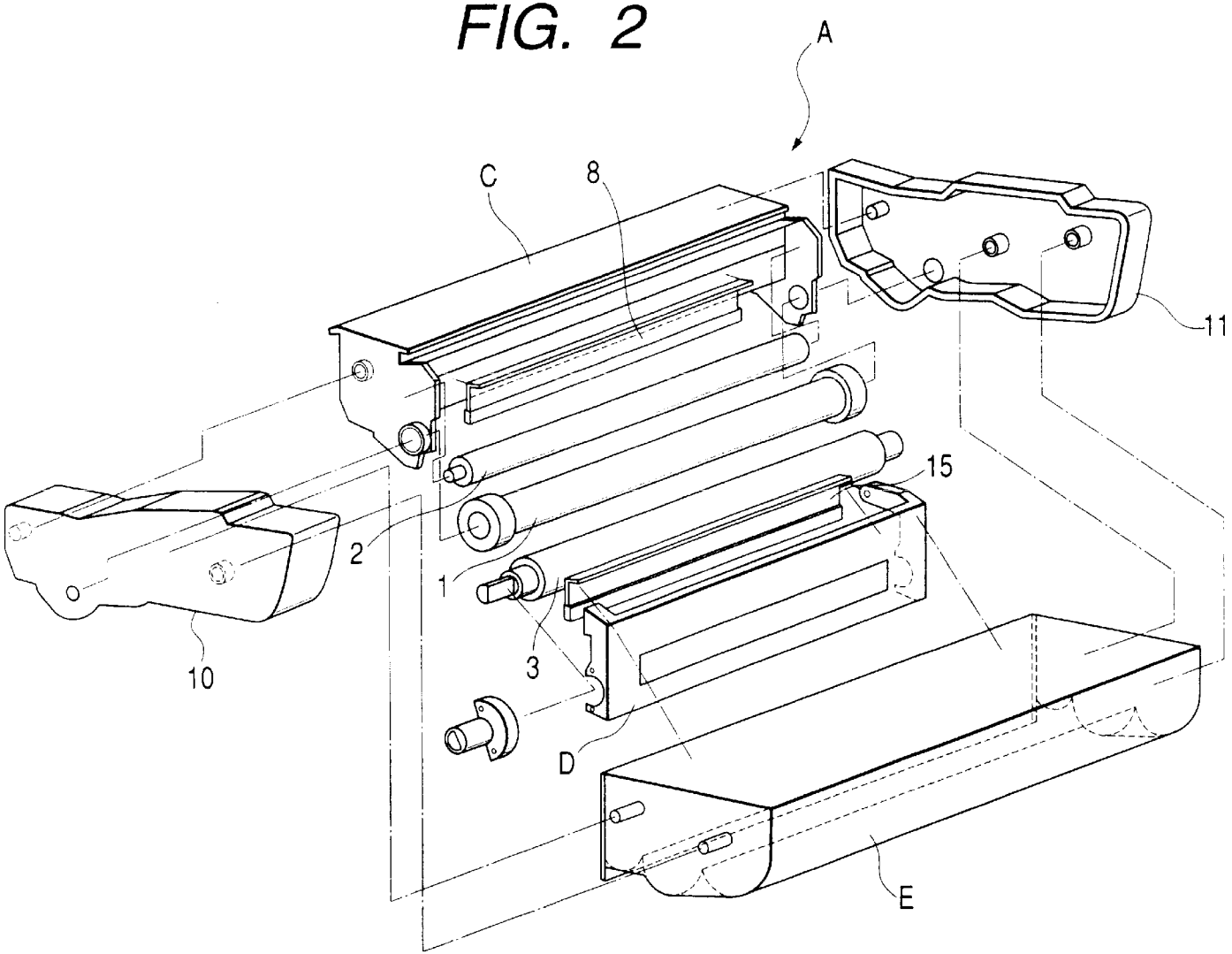
FIG. 2 is an exploded perspective view showing the construction of a process cartridge according to the present invention.

The process cartridge A, which will be described in detail below with reference to FIG. 2, is formed as an integral unit by combining the following components: a drum-shaped electrophotographic photosensitive member, i.e., a photosensitive drum 1, charging means 2 for uniformly charging the surface of the photosensitive drum 1, a roller-shaped developer bearing member opposed to the photosensitive drum 1 and serving as the developing means, i.e., a developing roller 3, a developing container D connected to the developing roller 3 and formed of a resin such as polystyrene, a developer container E serving as a developer-containing portion containing developer, and a cleaning container C having cleaning means 8.

In the laser beam printer B, serving as the image forming apparatus, there is arranged above the process cartridge A a laser scanner 4 for applying a laser beam in accordance with image information, and, below the process cartridge A, there is arranged transfer means 5 opposed to the photosensitive drum 1. In the image forming apparatus constructed as described above, image formation is performed as follows.

First, the photosensitive drum 1 is uniformly charged by the charging means 2, and its surface is scanned and exposed by the laser beam applied from the laser scanner 4, thereby forming an electrostatic latent image of the target image information. By the action of the developing roller 3, some developer T in the developing container D adheres to the electrostatic latent image, which is thereby visualized. In this embodiment, the developer used is an insulating magnetic monocomponent developer (toner). The developer is not restricted to the above-mentioned one. Any type of developer will do as long as it is a magnetic developer or an insulating magnetic developer.

The image on the photosensitive drum 1 is transferred by the transfer means 5 to a recording sheet S fed and conveyed from a feed cassette 6. The recording sheet S is passed through fixing means 7, whereby the image is fixed to the recording sheet S, which is discharged onto a discharge tray 9 outside the main body. After the developer image has been transferred to the recording sheet S, the developer T remaining on the photosensitive drum 1 is removed by the cleaning means 8 and collected in the cleaning container C.

Figure 3:
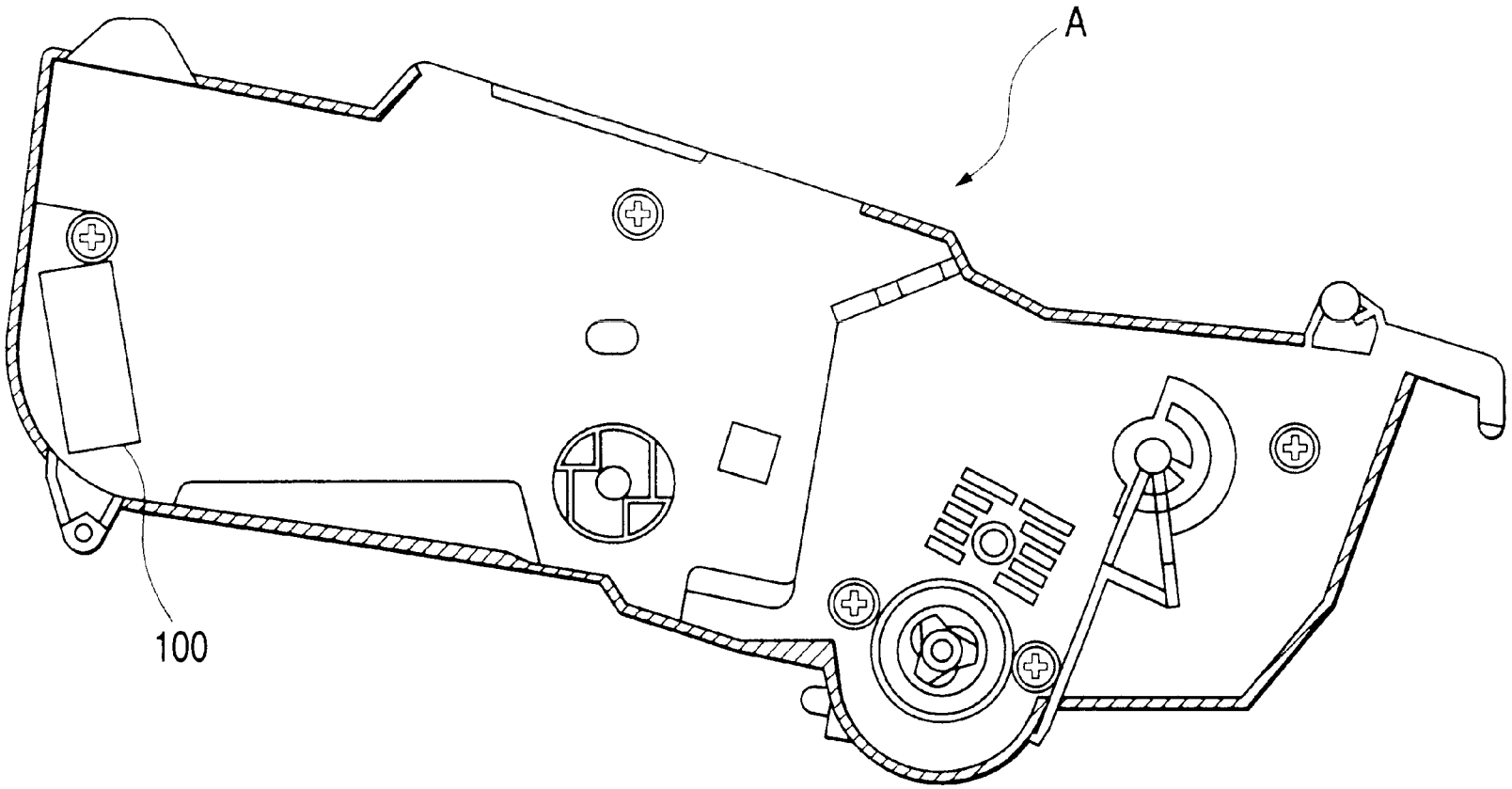
FIG. 3 is a side view of the process cartridge of the present invention, illustrating the arrangement of a memory unit.

Further, as shown in FIG. 3, a memory unit 100 serving as storage means is mounted in the process cartridge A. In this embodiment, the memory unit 100 is attached to a side surface of the process cartridge A.

(General System Configuration)

Figure 14:
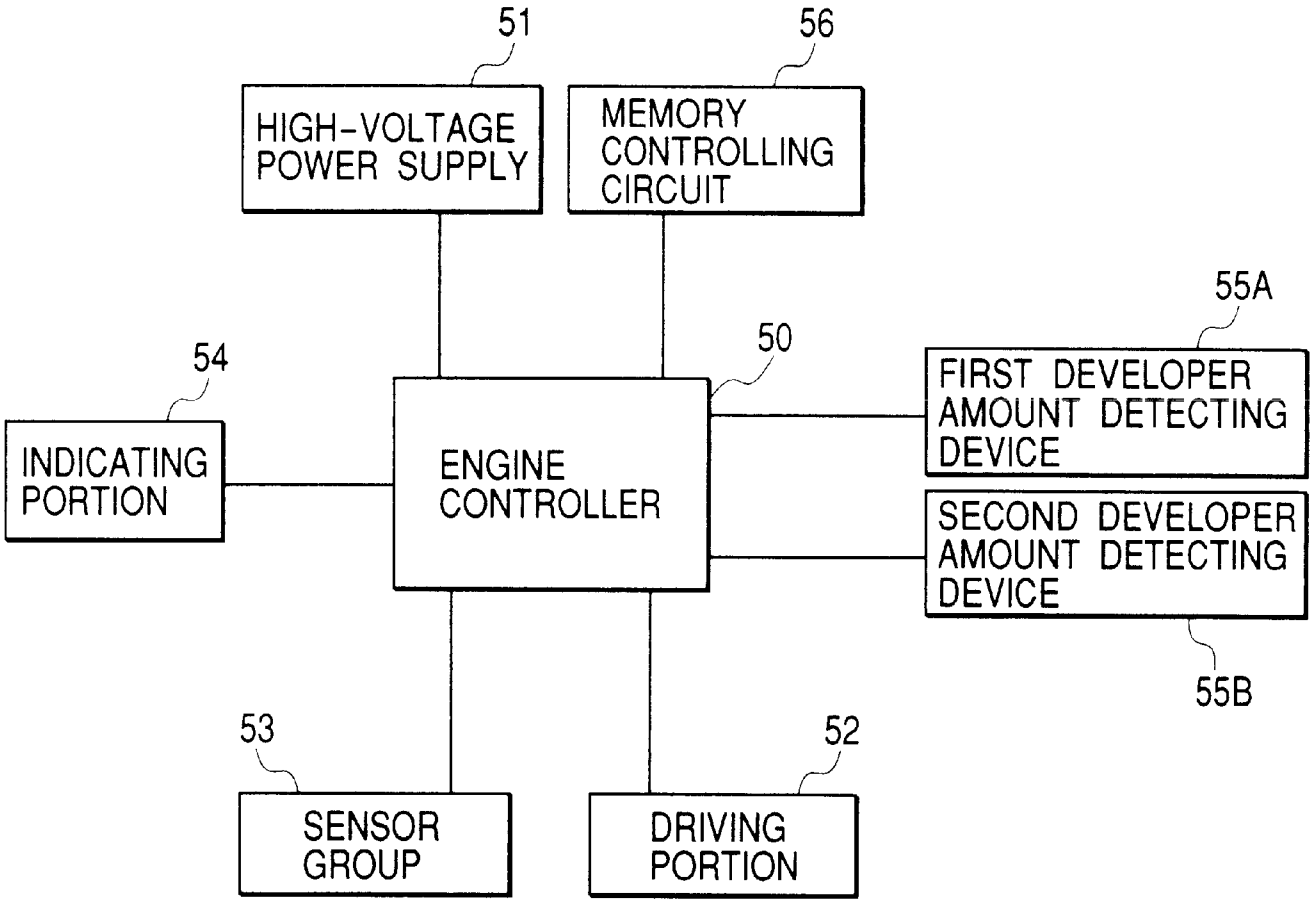
FIG. 14 is a system block diagram showing an image forming apparatus according to the present invention.

Next, the system configuration of the image forming apparatus of this embodiment will be described with reference to the system block diagram of FIG. 14.

There is provided an engine controller 50 for performing system control on the entire image forming apparatus, and a central processing unit (CPU) (not shown) is arranged inside the engine controller 50. A series of system-processing operations are conducted in accordance with a program previously stored in the central processing unit.

A high-voltage power supply 51 generates a charging bias which is to be supplied to the charging means 2 and which consists of a DC voltage and an AC voltage superimposed thereon, a developing bias which is to be supplied to the developing roller 3 and which consists of a DC voltage and an AC voltage superimposed thereon, a transfer bias which is a DC voltage to be supplied to the transfer means 5, and a fixing bias which is a DC voltage to be supplied to the fixing means 7.

Further, in the system configuration of this embodiment, there are provided a driving portion 52 including a motor, solenoid, etc. provided inside the apparatus, a sensor group 53 provided at a predetermined position in the image forming apparatus, an indicating portion 54 for indicating the condition of the apparatus, and first and second developer amount detecting devices 55A and 55B adapted to detect the capacitance of a developer detecting member in the process cartridge A to thereby detect the developer amount, the above-mentioned components being controlled by the engine controller 50. Further, connected to the engine controller 50 is a memory controlling circuit 56 for controlling the memory unit 100 mounted in the process cartridge.

(Description of Memory Unit)

Here, the memory unit 100 will be described, which, in this embodiment, is attached to a side surface of the process cartridge A, as shown in FIG. 3.

The memory unit 100 contains a nonvolatile built-in storage element, and is capable of writing and reading data by performing data communication with the image forming apparatus main body. The control of the data communication is all effected by the memory controlling circuit 56. The data communication is effected in a non-contact manner through magnetic coupling between an antenna provided in the memory unit 100 and an antenna provided in the image forming apparatus main body. When the process cartridge A is mounted to the laser printer B, the antenna of the memory unit 100 is brought close to the antenna provided in the laser printer B, whereby communication is possible. Further, a power supply circuit is provided in the memory unit 100; all the DC power used in the apparatus is supplied from this power supply circuit. In the power supply circuit, an electric current generated in the antennas through the magnetic coupling of the two antennas is rectified, thereby generating a DC voltage. In the memory unit 100, information on the process cartridge A, etc. is stored.

(Construction of Process Cartridge)

Figure 4:
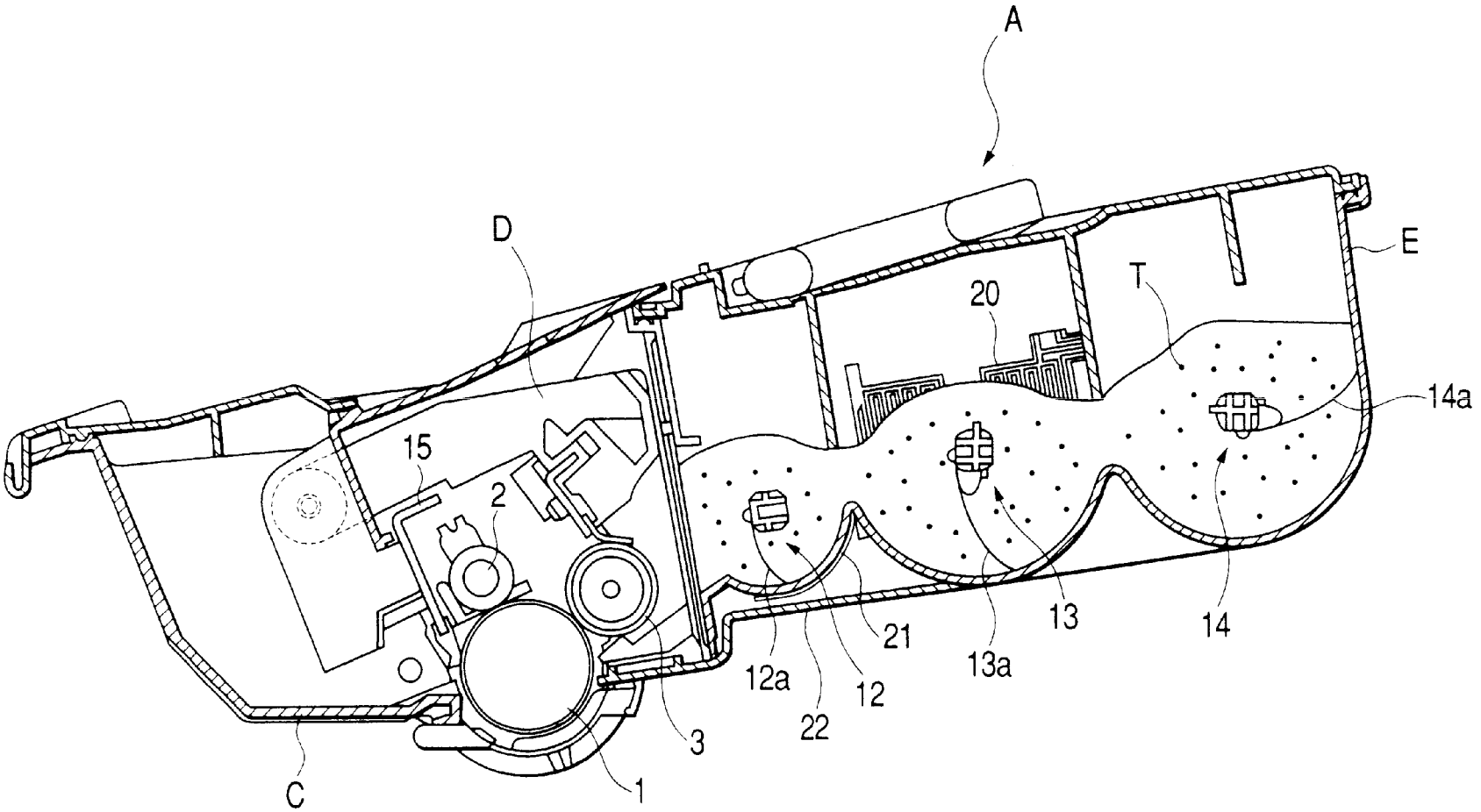
FIG. 4 is a sectional view of the process cartridge of the present invention.

FIG. 2 is an exploded perspective view of the process cartridge A of this embodiment, and FIG. 4 is a sectional view of the process cartridge A.

In FIG. 2, the process cartridge A of this embodiment has a developer container E containing developer, a developing container D for retaining the developing roller 3 serving as the developing member, a cleaning container C retaining the photosensitive drum 1 and the cleaning means 8, and side covers 10 and 11 retaining the developer container E and the cleaning container C, the containers being connected together to form a cartridge.

In FIG. 4, the developer container E has a horizontally elongated configuration to meet the demand for an increase in capacity, and the bottom surface of the developer container E exhibits three recesses. Three conveying members 12, 13, and 14 driven by a main body motor (not shown) are in correspondence with the recesses of the developer container E, and developer T is conveyed to the developing container D by agitating wing members 12*a*, 13*a*, and 14*a* provided on the conveying members 12, 13, and 14.

Due to the horizontally elongated configuration of the developer container E, the self-weight of the developer T is relieved, so that it is possible to mitigate fading, a deterioration in the developer, an increase in agitation torque, etc.

The agitating wing members 12*a* through 14*a* are formed of a resin-sheet material such as polyethylene terephthalate, polyphenylene sulfide or the like, and are adapted to agitate and convey the developer T. The rotation radius of the distal ends of the agitating wing members 12*a* through 14*a* is larger than the radius of the recesses of the bottom surface of the developer container E, and the distal ends rub against the bottom surface of the developer container E, whereby the developer T is horizontally conveyed, without leaving any developer T on the bottom surface of the developer container E.

(Construction of Developer Amount Detecting Members)

As shown in FIG. 4, in this embodiment, to successively detect the developer amount, a first detecting member 20 and a second detecting member 21 are provided. The first detecting member 20 performs detection in the region in which the amount of developer T is relatively large, and the second detecting member 21 performs detection in the region in which the amount of developer T is relatively small.

More specifically, the first detecting member 20 performs detection from the initial stage of use to the stage at which the developer amount is reduced to approximately 50 to 10%, and the second detecting member 21 performs detection from the stage at which the developer amount is approximately 50 to 10% to the stage at which there is no developer left. Both the first detecting member 20 and the second detecting member 21 perform developer-amount measurement based on capacitance.

Figure 5A:
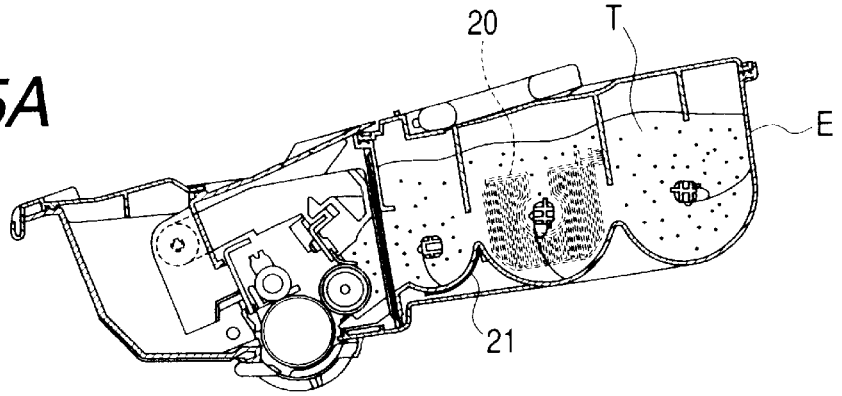
FIG. 5A, 5B, 5C and 5D are sectional views of a developer container, showing how developer is consumed.
Figure 5B:
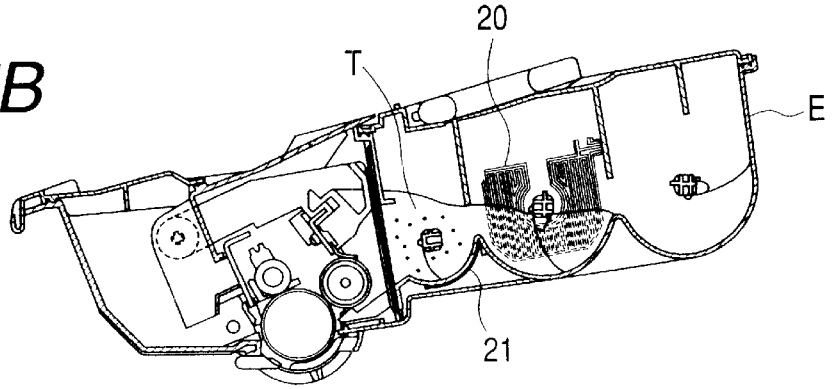
Figure 5C:
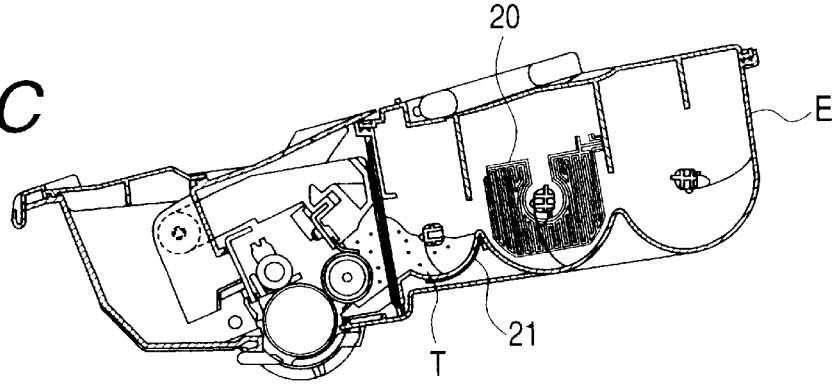
Figure 5D:
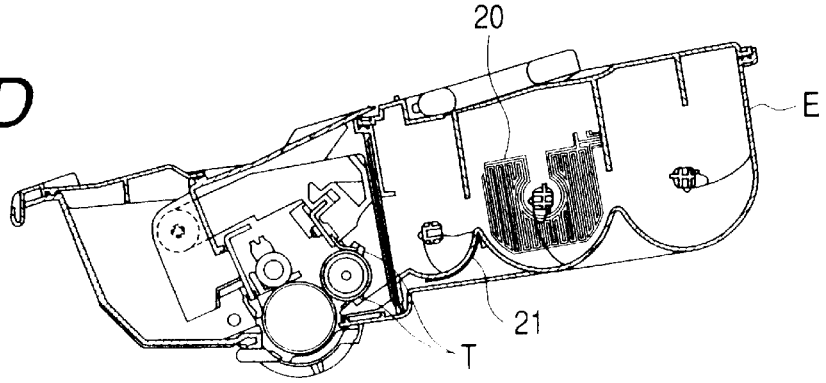
Figure 6:
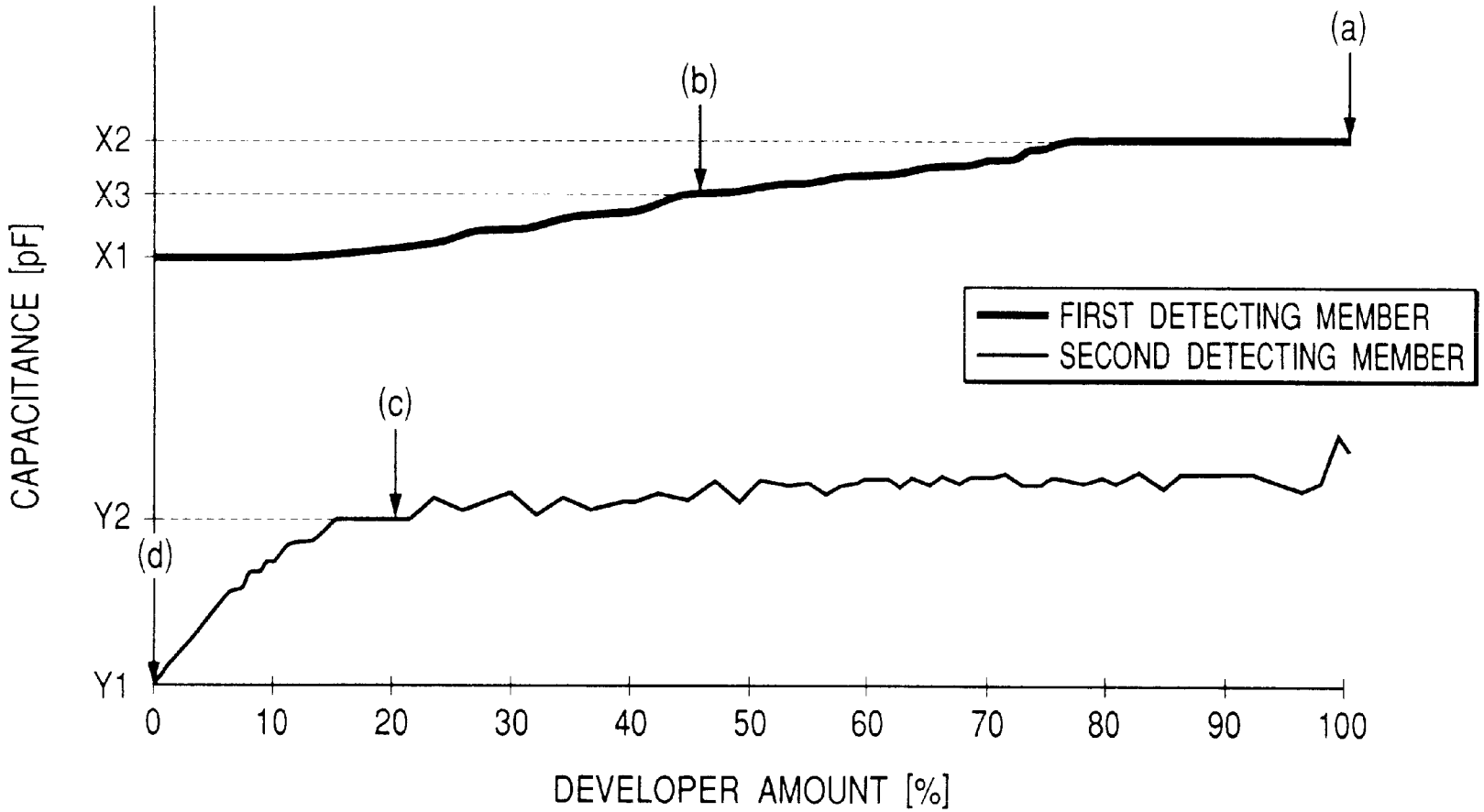
FIG. 6 is a graph showing the relationship between the developer amount and the capacitance in a developer-amount detecting device according to the present invention.

FIGS. 5A, 5B, 5C, and 5D show how the developer amount varies, and FIG. 6 shows the relationship between developer amount and the capacitance. In this embodiment, the transition from the first detecting member 20 to the second detecting member 21 is effected when the developer amount has been reduced to approximately 20%. FIGS. 5A, 5B, 5C, and 5D are respectively in correspondence with points (a), (b), (c), and (d) in FIG. 6.

At the stage corresponding to point (a), the developer amount is 100%, and both the first detecting member 20 and the second detecting member 21 are buried in developer (FIG. 5A). At this time, the output of the first detecting member 20 is X2.

At the stage corresponding to point (b), the amount of the portion of the developer that is in the detection region for the first detecting member 20 varies as the developer is gradually consumed (FIG. 5B). As the area of the portion of the developer that is in contact with the surface of the first detecting member 20 varies, the output of the detecting member varies. At this time, the output of the first detecting member 20 is X3.

At the stage corresponding to point (c), the developer amount is reduced to approximately 20%, and the second detecting member 21 starts to operate (FIG. 5C). At this time, the output of the second detecting member 21 is Y2.

At the stage corresponding to point (d), detection is continued until the developer amount becomes 0% (FIG. 5D). At this time, the output of the second detecting member 21 is Y1. Thus, detection can be successively effected over the entire range from the initial to the last stage of use of the process cartridge A.

(Principle and Construction of First Detecting Member)

Figure 7:
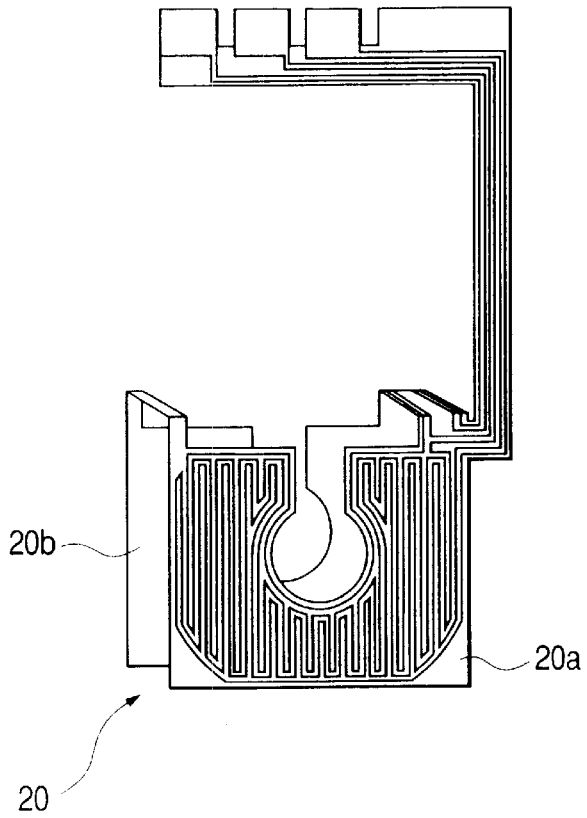
FIG. 7 is a perspective view of a first detecting member of the present invention.
Figure 8:
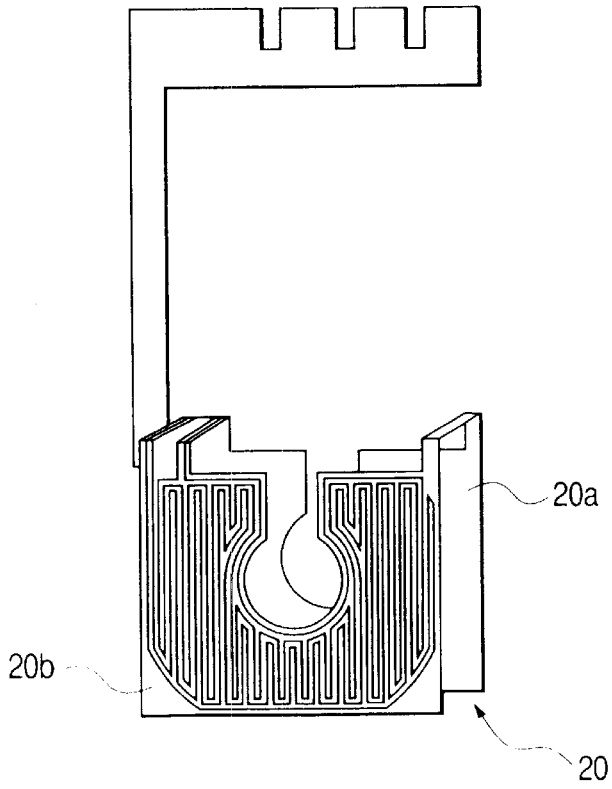
FIG. 8 is a perspective view of the first detecting member of the present invention.
Figure 9:
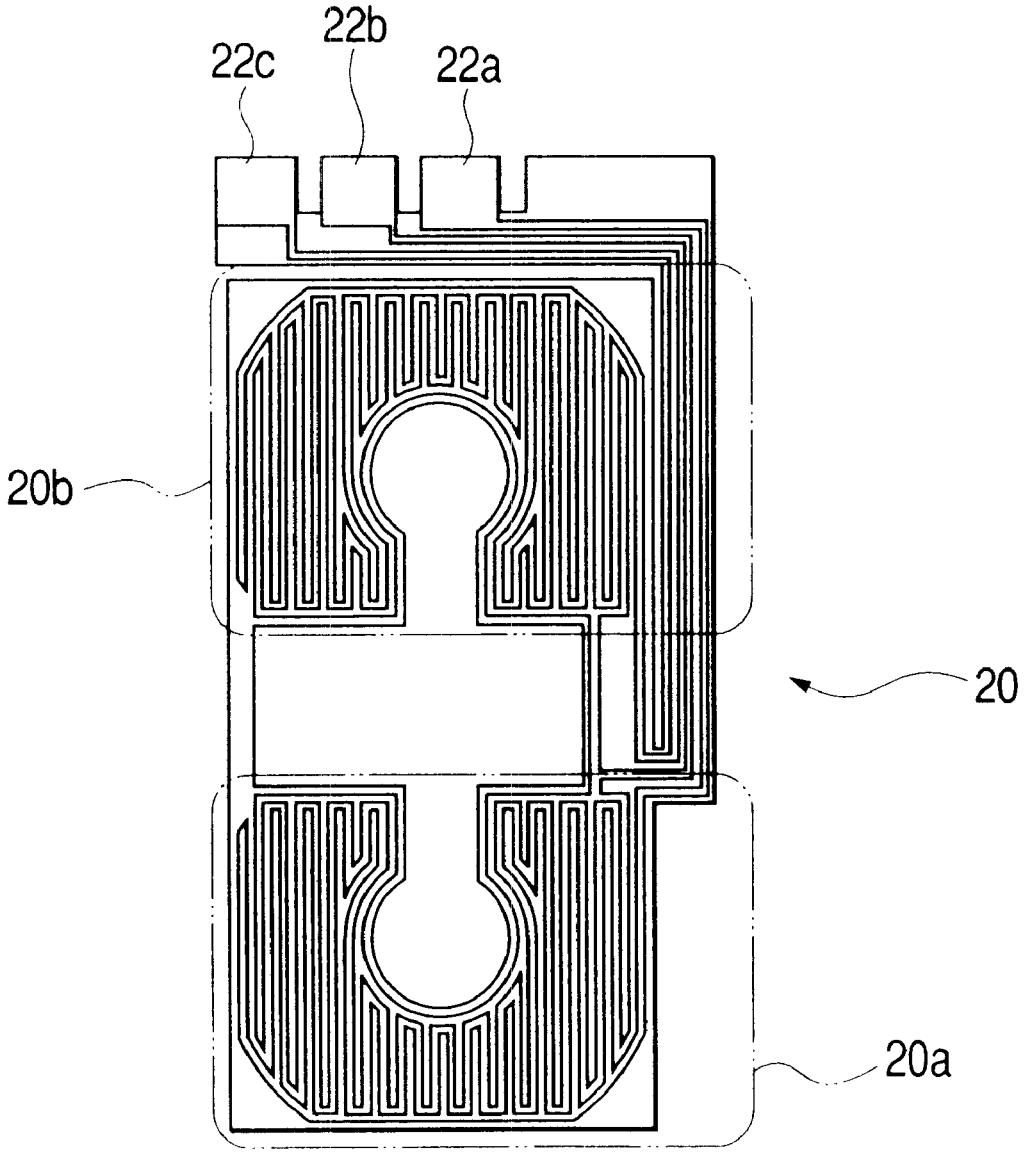
FIG. 9 is a developed view of the first detecting member of the present invention.

Next, the operating principle of the first and second detecting members 20 and 21 will be described. First, FIG. 7 shows the first detecting member 20. FIG. 8 is a view of the first detecting member 20 as seen from the side opposite to that of FIG. 7, and FIG. 9 is a developed view of the first detecting member 20. In FIG. 9, the first detecting member 20 has a measurement-side output electrode 22*a*, a reference-side output electrode 22*c*, and a common input electrode 22*b*. A combination of the measurement-side output electrode 22*a* and the common input electrode 22*b* serves as a measurement electrode 20*a*, and a combination of the reference-side output electrode 22*c* and the common input electrode 22*b* serves as a reference electrode 20*b*.

In FIGS. 7 and 8, the measurement electrode 20*a* is arranged at a position inside the developer container E where it comes into contact with the developer T, for example, a position on the inner side surface of the container. By measuring the capacitance between the electrodes 22*a* and 22*b*, which constitute a pair, it is possible to detect a variation in the area of the portion of the developer which is in contact with the electrode surface, thereby making it possible to ascertain the amount of developer in the developer container E. That is, since the dielectric constant of the developer T is larger than that of air, a variation in the area of the portion of the developer T which is in contact with the surface of the first detecting member 20 results in a variation in the capacitance between the electrodes 22*a* and 22*b*.

The reference electrode 20*b* is arranged inside the developer container E at a position where the reference electrode

20*b* is out of contact with the developer T. It is designed to exhibit a variation in capacitance similar to that of the measurement electrode 20*a* when the environmental condition is varied. In this embodiment, the measurement electrode 20*a* and the reference electrode 20*b* have the same electrode pattern configuration. Thus, by subtracting the value of the capacitance of the reference electrode 20*b* from the value of the capacitance of the measurement electrode 20*a*, it is possible to assume that there is no variation in capacitance due to the environmental condition, thereby making it possible to achieve an improvement in detection accuracy.

As shown in FIG. 9, the first detecting member 20 is preferably formed by providing the measurement electrode 20*a* and the reference electrode 20*b* on one side of a flexible board, such as a flexible print board, which is folded and arranged inside the developer container E. The edges or the entire back surface of the first detecting member 20 is fastened to the developer container E by using an adhesive double coated tape or the like so that none of the developer may be allowed to get behind the measurement electrode 20*a*.

(Arrangement of First Detecting Member)

Figure 10:
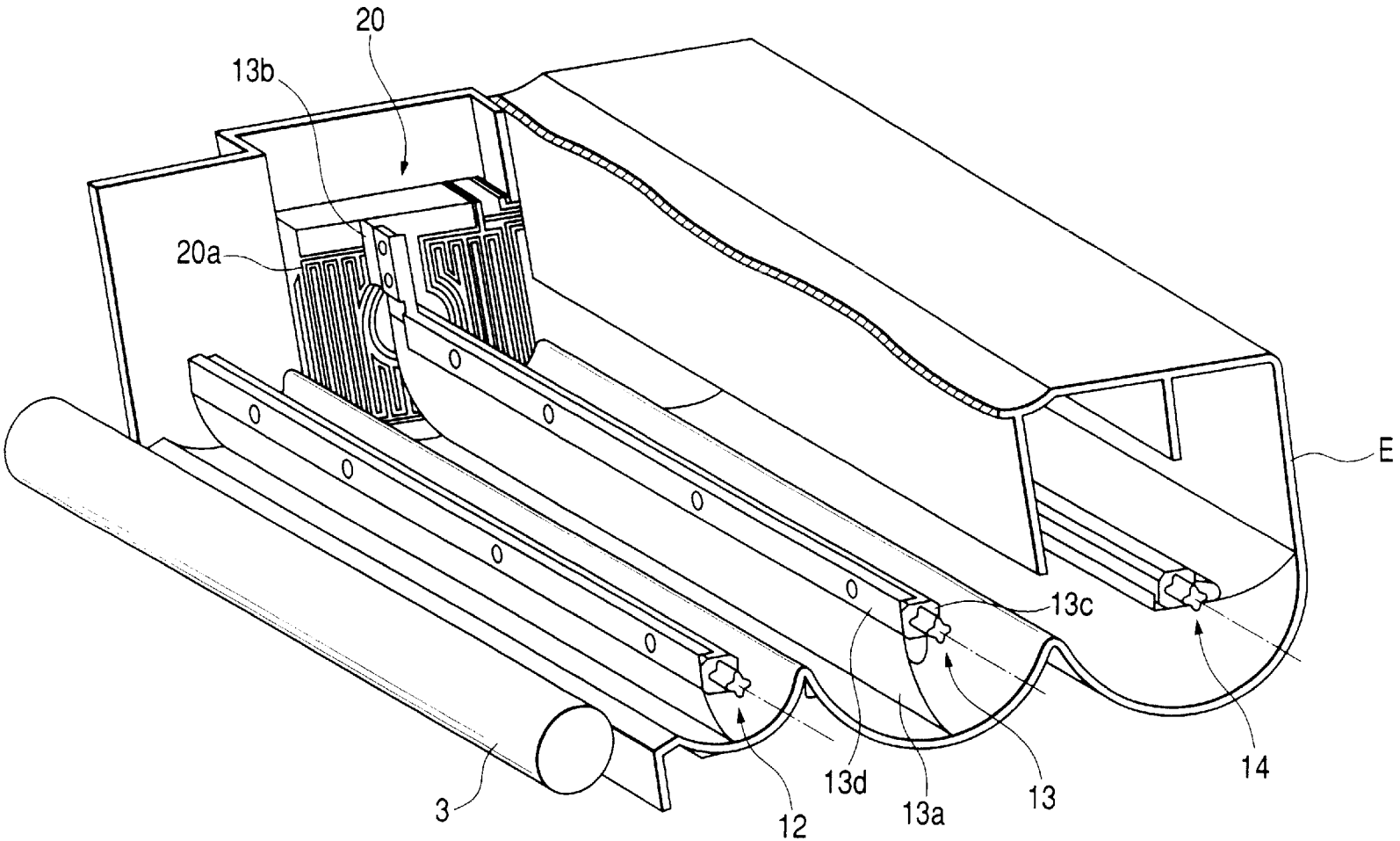
FIG. 10 is a perspective view of a developer container according to the present invention.

FIG. 10 is a perspective view of the developer container E, which is provided with the three conveying members 12, 13, and 14. The first detecting member 20 is positioned in the region where the conveying member 13, which is the second conveying member as counted from the developing roller 3 side, is arranged, and the developer T that has reached this region is conveyed to the acting region for the second detecting member 21 described below.

That is, in this embodiment, the first detecting member 20 is arranged in the developer container E at a position on the upstream side of the second detecting member 21 in the developer supplying direction, i.e., the direction in which the developer T contained in the container E is supplied toward the developing roller 3.

Further, the first detecting member 20 is arranged on the driving-side side wall of the developer container E so as to surround the shaft of the conveying member 13. By arranging the first detecting member 20 at this position, it is possible to reduce the area of the first detecting member 20 while realizing successive detection, so that it is possible to achieve a reduction in parts cost. Further, by positioning the first detecting member so as to be spaced apart from the developing roller 3, it is possible to minimize the influence of the developing bias.

The first detecting member 20 exhibits very high sensitivity in the vicinity of the surface thereof, so that it is effective, in enhancing the detection accuracy, to provide a surface wiping member 13*b* as means for removing any developer on the surface of the detecting member. In doing so, it is desirable to provide the wiping member 13*b* on the developer conveying member 13 to thereby simplify the structure. Further, in this case, the first detecting member 20 is arranged in the function range for the wiping member 13*b*, which is in correspondence with the developer agitating region.

(Construction of Wiping Member)

As shown in FIG. 10, in this embodiment, the surface wiping member 13*b* for the first detecting member 20 is provided on the developer conveying member 13. The wiping member 13*b* is provided only on the conveying member 13, which is at the position where the first detecting member 20 is provided.

The developer conveying member 13 includes an agitating rod member 13*c*, an agitating wing member 13*a*, an agitating wing holding member 13*d*, and the wiping member 13*b*. The agitating rod member 13*c* is rotatably supported by the developer container E. The agitating wing member 13*a* is pressed against the agitating rod member 13*c* and fastened thereto by the agitating wing holding member 13*d*. The agitating wing holding member 13*d* is formed of sheet metal or resin and secured to the agitating rod member 13*c* by heat caulking, ultrasonic welding, adhesion or the like. Like the agitating wing member 13*a*, the wiping member 13*b* is secured in position by the agitating wing holding member 13*d*. The agitating wing member 13*a* is formed of a resin material, such as polyethylene terephthalate or polyphenylene sulfide. The wiping member 13*b* may be formed of a resin sheet material such as polyethylene terephthalate or polyphenylene sulfide, rubber or foam material. That is, an arbitrary material can be employed for the wiping member 13*b* as long as it is suitable for wiping of the surface of the first detecting member 20.

Figure 11:
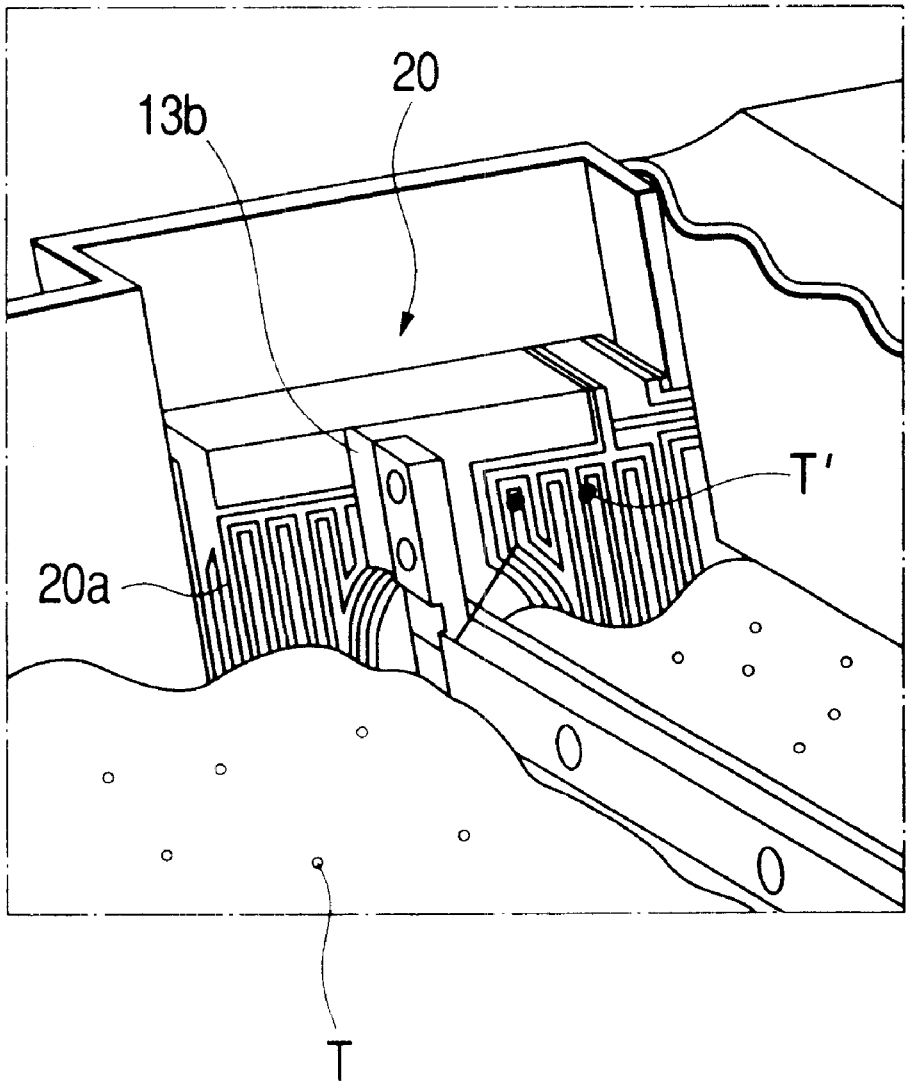
FIG. 11 is a perspective view showing how a wiping member of the present invention operates.

FIG. 11 shows the first detecting member 20 in a state in which the developer has been consumed to some extent. In this state, there exists adhering developer T' above the developer surface. The presence of the adhering developer T' leads to an increase in the capacitance of the measurement electrode 20*a* of the first detecting member 20, resulting in discrepancies. By wiping the first measurement electrode 20*a* by the wiping member 13*b*, it is possible to remove the adhering developer which is above the developer surface, thereby making it possible to achieve an improvement in terms of detection accuracy.

(Process for Detecting Capacitance by First Detecting Member)

Next, the process for detecting capacitance by using the first detecting member 20 will be described in detail. In the developer-amount detecting system of this embodiment, the first detecting member 20 serving as the first capacitance generating member is connected to the first developer amount detecting device 55A shown in FIG. 14, where the capacitance of the first detecting member 20 is detected.

Figure 15:
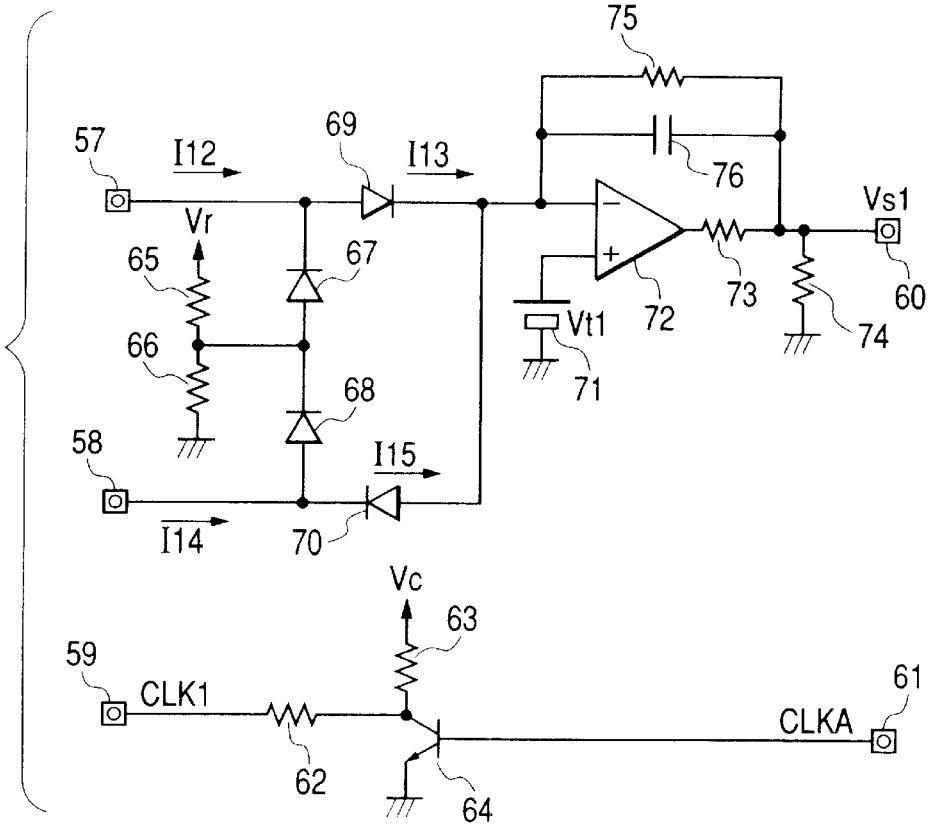
FIG. 15 is an inner circuit diagram of a first developer-amount detecting device in the present invention.

FIG. 15 is a diagram showing the inner circuit configuration of the developer amount detecting device 55A. A terminal 59 is connected to the electrode 22*b* of the first detecting member 20 via an electric contact (not shown) whose contact portion is exposed through the cartridge frame, and is adapted to output a clock CLK1 for detecting the developer amount. The clock CLK1 is generated by resistors 62 and 63 and a transistor 64. A signal CLKA is a clock output from the engine controller 50, and is a rectangular wave having a frequency fc of 50 KHz and a duty of 50%. The signal CLKA is amplified to an amplitude of Vc by the transistor 64 and output from the terminal 59.

A terminal 57 is connected to the measurement-side output electrode 22*a* of the first detecting member 20 via an electric contact (not shown) whose contact portion is exposed through the cartridge frame. When the clock output from the terminal 59 is applied to the electrode 22*b*, an AC current I12 flows through the terminal 57 due to the capacitance Ct between the electrodes 22*a* and 22*b*. Here, the magnitude of the AC current I12 is of a value corresponding to the value of the capacitance Ct. The AC current I12 is rectified by diodes 69 and 67 provided in the input portion of the terminal 57, and a current I13 obtained through the rectification is input to an integration circuit formed by an operation amplifier 72, a resistor 75, and a capacitor 76. Here, the current I13 is a current corresponding to a one-direction component (hereinafter referred to as "half-wave current") of the current I12.

A terminal 58 is connected to the reference-side output electrode 22*c* of the first detecting member 20 through an electric contact (not shown) whose contact portion is exposed through the cartridge frame. Due to the clock output from the terminal 59, an electric current I14 of a magnitude corresponding to the capacitance Cr between the electrode 22*b* and the electrode 22*c* flows through the terminal 58. The electric current I14 is rectified by diodes 68 and 70 set to a direction opposite to the input portion of the terminal 57, and an electric current I15 is input to the integration circuit. The electric current I15 is a half-wave current of a polarity opposite to that of the electric current I13. The electric currents I13 and I15 input to the integration circuit are integrated, and a DC voltage Vd1 according to the average value of the sum total of the current I13 and the current I15 is generated across a resistor 75. Assuming that the resistance value of the resistor 75 is Rs1, the voltage Vd1 can be approximated by the following equation.

$$Vd1=Rs1\times fc\times Vc\times(Ct-Cr) \quad (1)$$

A reference voltage Vt1 is input from the power supply 71 to the positive input terminal of the operation amplifier 72, and the output voltage Vs1 of the operation amplifier 72 has a characteristic that can be expressed by the following equation.

$$Vs1=Vt1-Rs1\times fc\times Vc\times(Ct-Cr) \quad (2)$$

As shown by the above equation, the output voltage Vs1 of the operation amplifier 72 is the difference between the capacitance between the electrodes 22*a* and 22*b* on the measurement electrode 20*a* side and the capacitance between the electrodes 22*c* and 22*b* on the reference electrode 20*b* side, that is, a voltage value according to the amount of developer in the process cartridge A. The output Vs1 of the operation amplifier is output from an output terminal 60.

The terminal 60 is connected to the analog-digital conversion terminal of the central processing unit in the engine controller 50. The voltage level Vs1, which is in correspondence with the developer amount, is converted to digital data, and is compared with a conversion table previously stored in the engine controller 50, whereby it is converted to the developer amount T1 in the process cartridge A.

(Construction and Arrangement of Second Detecting Member)

Figure 12:
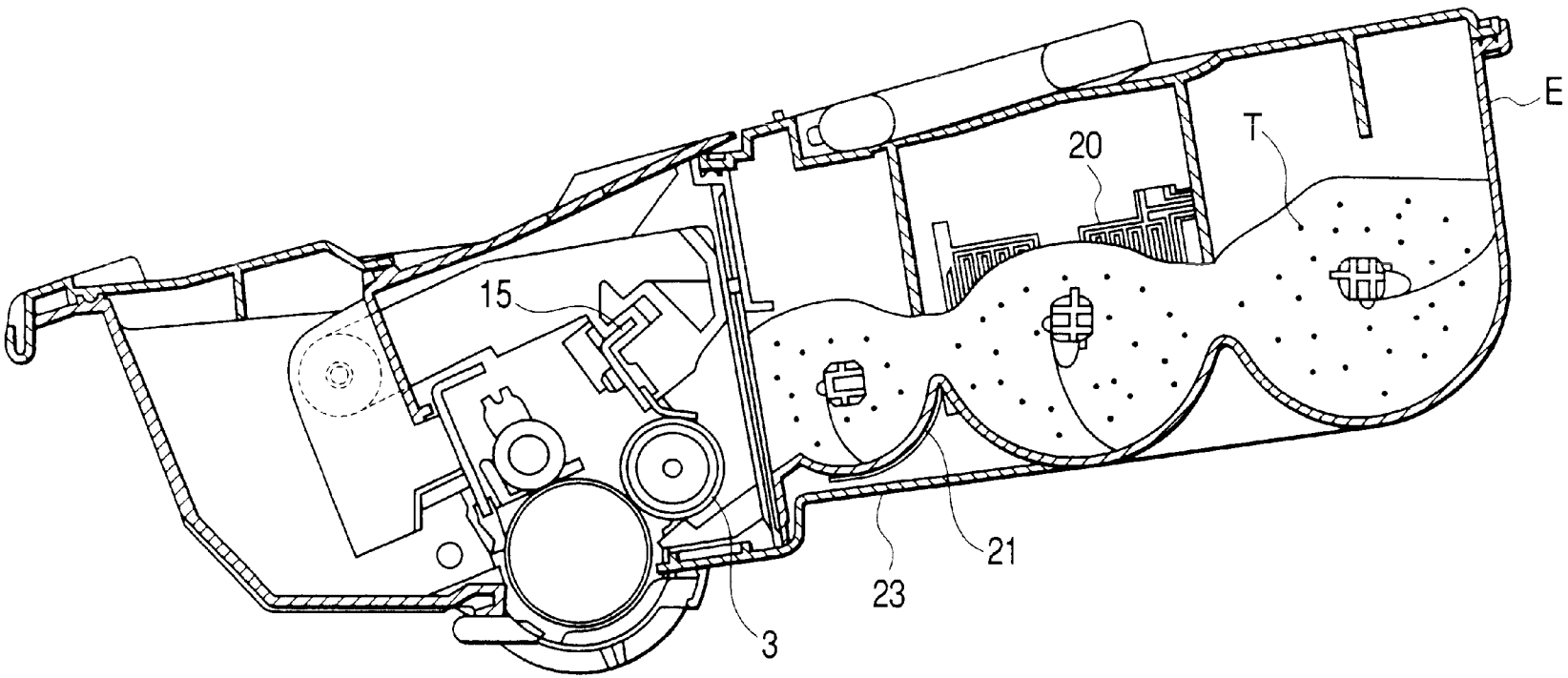
FIG. 12 is a sectional view of the process cartridge, illustrating a second detecting member of the present invention.
Figure 13:
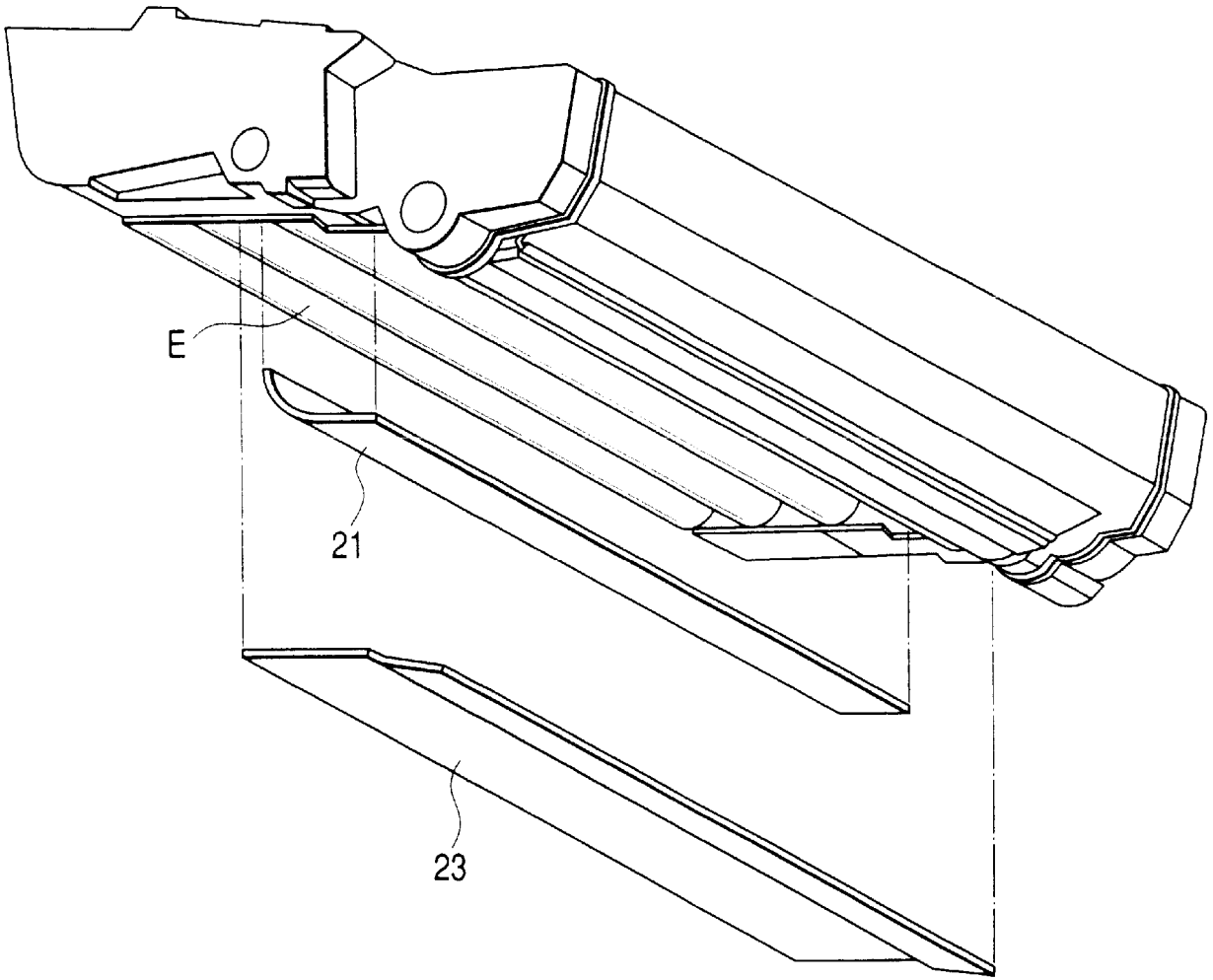
FIG. 13 is a perspective view as seen from below of the process cartridge, illustrating where the second detecting member of the present invention is arranged.

FIG. 12 is a sectional view of the developer container E, and FIG. 13 is a perspective view as seen from below of the developer container E. The second detecting member 21 is provided outside the developer container E. Further, a cover member 23 is provided on the outer side of the second detecting member 21.

The second detecting member 21 is formed of sheet metal, and extends over the entire longitudinal range so as to be in conformity with the outside protruding configuration according to the inside recess of the bottom surface of the developer container E. The developing roller 3 and the developer regulating member supporting member 15 are electrically connected to each other, and a variation in the capacitance between the second detecting member 21, the developing roller 3, and the developer-regulating-member supporting member 15 is measured, whereby the developer amount is detected.

The second detecting member 21 is outside the developer container E, and is fastened to the protrusion of the developer container E which is nearest to the developing roller 3 by caulking, adhesion or the like. By providing the second detecting member 21 outside the developer container E, there is no need for wiring to run inside the developer container E to the contact connected to the image forming apparatus main body, so that there is no fear of developer leakage.

(Process for Detecting Capacitance by Second Detecting Member)

Next, the process for detecting the capacitance by using the second detecting member 20 will be described in detail. In the developing-amount detecting system of this embodiment, the second detecting member 21 as the second capacitance generating portion is connected to the second developer-amount detecting device 55B of FIG. 14, and the value of the capacitance between the second detecting member 21, the developing roller 3, and the developer-regulating-member supporting member 15 is detected.

Figure 16:
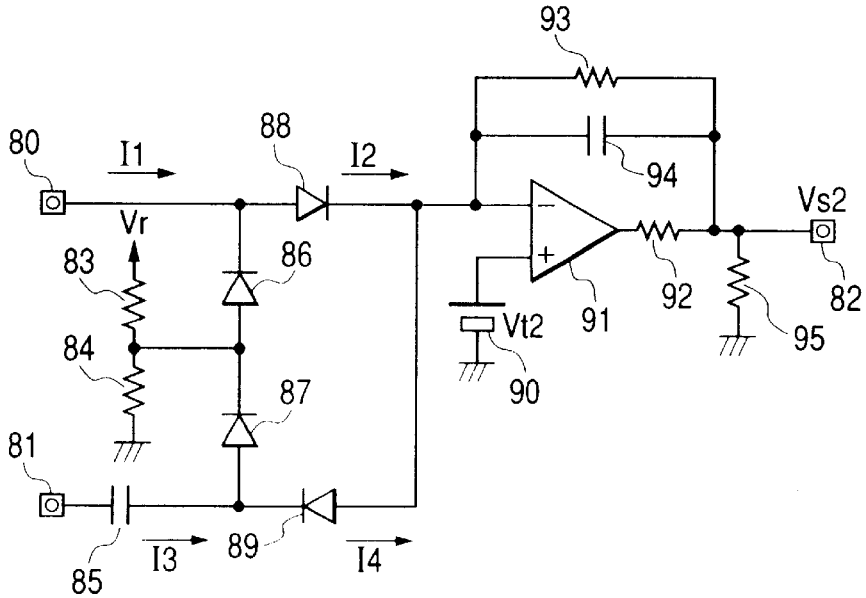
FIG. 16 is an inner circuit diagram of a second developer-amount detecting device in the present invention.

FIG. 16 is an inner circuit diagram of the second developer-amount detecting device 55B. A terminal 80 is connected to the second detecting member 21 via an electric contact (not shown). When a developing AC bias generated in the high-voltage power supply 51 is applied to the developing roller 3, an AC current I1 flows through the terminal 80 due to the capacitance Cs between the second detecting member 21. the developing roller 3, and the developer-regulating-member supporting member 15. Here, the magnitude of the current I1 is of a value corresponding to the capacitance value Cs. The electric current I1 is rectified by diodes 86 and 88 provided in the input portion of the terminal 80, and an electric current I2 obtained through the rectification is input to an integration circuit formed by an operation amplifier 91, a resistor 93, and a capacitor 94. Here, the electric current I2 is a half-wave current of the electric current I1.

A terminal 81 is connected to a developing bias output portion (not shown) in the high-voltage power supply 51. That is, the same developing bias as that of the developing roller 3 is applied to the terminal 81. A capacitor 85 of a capacitance Ck is connected to the input portion of the terminal 81. When a developing AC bias is applied thereto, an AC current I3 of a magnitude corresponding to the capacitance Ck flows.

The capacitor 85 is a reference capacitor serving as a measurement reference, and its capacitance value Ck is set to the value of the capacitance between the second detecting member 21, the developing roller 3, and the developer-regulating-member supporting member 15 when there is no developer in the process cartridge A. The electric current I3 is rectified by diodes 87 and 89 set to a direction opposite to the input portion of the terminal 80, and an electric current I4 is input to the integration circuit. The electric current I4 is a half-wave current of a polarity opposite to that of the electric current I2. The electric current I2 and the electric current I4 that are input to the integration circuit are integrated, and a DC voltage Vd2 corresponding to the average value of the sum total of the electric currents I2 and I4 is generated across the resistor 93. Assuming that the frequency and amplitude of the developing AC bias is fd and VP, and that the resistance value of the resistor 93 is Rs2, Vd2 can be approximated by the following equation.

$$Vd2=Rs2\times fd\times Vp\times(Cs-Ck) \quad (3)$$

A predetermined reference voltage Vt2 is input from the power supply 90 to the positive input terminal of the operation amplifier 91, and the output of the operation amplifier 91 has a characteristic that can be expressed by the following equation.

$$Vs2=Vt2-Rs2\times fd\times Vp\times(Cs-Ck) \quad (4)$$

As shown by the above equation, the output voltage *Vs*2 of the operation amplifier is a voltage value corresponding to the difference between the capacitance between the second detecting member 21, the developing roller 3, and the developer-regulating-member supporting member 15 and the capacitance of the reference capacitor 85, that is, a voltage value corresponding to the developer amount in the process cartridge A. The output Vs2 of the operation amplifier 91 is output from an output terminal 82. The output terminal 82 is connected to an analog-digital conversion terminal of the central processing unit in the engine controller 50.

The voltage level Vs2 corresponding to the developer amount is converted to digital data, and is compared with a conversion table previously stored in the engine controller 50 to be thereby converted to the developer amount T2 in the process cartridge A.

The developer amount T1 detected by the first detecting member 20 and the developer amount T2 detected by the second detecting member 21 are compared with each other in the engine controller 50, and the value of the developer amount T1 or that of the developer amount T2 is indicated through an indicating portion 54 to inform the user of the value. Further, the detection value of the detected developer amount is stored in the process-cartridge-memory unit 100. The indicating portion 54 may be a display provided on the image processing apparatus main body or the display of a personal computer capable of communication by a communication means provided in the image forming apparatus main body.

In the above-described construction, by providing the first detecting member 20, the second detecting member 21, and the wiping member 13*b*, it is possible to successively detect the remaining amount of developer in the developer container E as it is consumed, over the entire range from the moment directly after the start of use of the process cartridge to the moment directly before the developer is used up.

Second Embodiment

While the first embodiment has been described with reference to the process cartridge A or an image forming apparatus provided with the process cartridge A, the principle of the present invention described above is also applicable to a developing device which is formed by removing the photosensitive drum 1, the charging means, and the cleaning means 8 from the process cartridge A.

That is, the developer container E and the developer-amount detecting system described in connection with the first embodiment of the present invention are also applicable to a developing device having a developer bearing member, a developer container, etc. and adapted to develop an electrostatic latent image formed on an electrophotographic photosensitive member, making it possible to achieve the same effect as that of the first embodiment.

In the above-described embodiment, it is possible to perform detection successively and with high accuracy over the entire developer-amount range, making it possible to inform the user of detection information obtained through successive detection of the developer as the developer amount.

Further, in the above-described embodiment, provided with several developer conveying members, the second detecting member is arranged so as to extend along the developer container such that a part of the operating region of the developer conveying member nearest to the developer bearing member is placed between the second detecting member and the developer bearing member, whereby the second detecting member is enabled to ascertain the developer amount at a point in time well before the moment when image formation becomes impossible, i.e., when there is a sufficient amount of developer left. Further, since it is arranged along the developer container, the second detecting member does not hinder the supply of developer to the developing roller.

Further, in the above-described embodiment, the first detecting member is provided on a surface of the developer container and in the operating region for the developer removing member, whereby it is possible to obtain an output exhibiting linearity to some extent as the developer amount varies. And, by providing the first detecting member in the operating region for the developer removing member, it is possible to remove any developer adhering to a portion above the developer surface, thereby achieving an improvement in terms of accuracy.

Further, in the above-described embodiment, the developer removing member is attached to the developer conveying member so as to be in contact with the surface of the first detecting member to wipe off any developer from the surface of the first detecting member, and the first detecting member is provided around the developer conveying member which is at the position where the developer is conveyed from the acting region for the first detecting member to the acting region for the second detecting member, whereby the variation in the developer amount in the acting region for the second detecting member starts substantially simultaneously with the ending of the variation in the developer amount in the detecting region for the first detecting member, thereby making it possible to perform developer-amount detection without interruption.

In accordance with the present invention described above, it is possible to obtain a stable detection value as the developer is consumed, and the remaining amount of developer can be measured successively and with high accuracy.

While the present invention has been described with reference to the structure disclosed herein, it is not confined to the details set forth and this application is intended to cover such modifications or changes as may come within the purposes of the improvements or the scope of the following claims.

What is claimed is:

1. A developer container for containing a developer, comprising:

(a) a first detecting member which is an electrode member having a pair of input-side and output-side electrodes formed in parallel and in one plane at a predetermined interval for detecting the capacitance between the electrodes and which has a measurement-side electrode that is in contact with the developer and a reference electrode that is out of contact with the developer;

(b) a developer removing member for removing any developer adhering to a detection region of the first detecting member; and (c) a second detecting member formed of a conductive material for detecting the capacitance between the second detecting member and a developer bearing member, wherein a main body of an electrophotographic image forming apparatus first detects the developer amount partway from a start of use of the developer container based on detection information from the first detecting member, and then detects the developer amount based on detection information from the second detecting member.

2. A developer container according to claim 1, further comprising a plurality of developer conveying members, wherein the second detecting member is arranged along the developer container such that a part of an acting region of a developer conveying member nearest to the developer bearing member is placed between the second detecting member and the developer bearing member.

3. A developer container according to claim 1, wherein the first detecting member is provided on a side surface of the developer container and in an acting region of the developer removing member.

4. A developer container according to claim 1, 2 or 3, wherein the developer removing member is attached to a developer conveying member and is in contact with a surface of the first detecting member to wipe off any developer from the surface of the first detecting member.

5. A developer container according to claim 4, wherein the first detecting member is provided around the developer conveying member which is at a position where the developer is conveyed to an acting region of the second detecting member.

6. An electrophotographic image forming apparatus for forming an image on a recording medium, comprising:

(a) an electrophotgraphic photosensitive member;

(b) an electrostatic latent image forming means for forming an electrostatic latent image on the electrophotographic photosensitive member;

(c) a developer container for containing a developer, including:

a first detecting member which is an electrode member having a pair of input-side and output-side electrodes formed in parallel and in one plane at a predetermined interval for detecting the capacitance between the electrodes and which has a measurement-side electrode that is in contact with the developer and a reference electrode that is out of contact with the developer;

a developer removing member for removing any developer adhering to a detection region of the first detecting member; and a second detecting member formed of a conductive material for detecting the capacitance between the second detecting member and a developer bearing member; and (d) detecting means for successively detecting a remaining amount of developer based on detection information from the first detecting member and the second detecting member, wherein the amount of developer in the developer container is detected.

7. A process cartridge which is detachably mountable to a main body of an electrophotographic image forming apparatus, the process cartridge comprising:

(a) an electrophotographic photosensitive member;

(b) a developing means for developing an electrostatic latent image formed on the electrophotographic photosensitive member;

(c) a first detecting member which is an electrode member having a pair of input-side and output-side electrodes formed in parallel and in one plane at a predetermined interval for detecting the capacitance between the electrodes and which has a measurement-side electrode that is in contact with the developer and a reference electrode that is out of contact with the developer;

(d) a developer removing member for removing any developer adhering to a detection region of the first detecting member; and (e) a second detecting member formed of a conductive material for detecting the capacitance between the second detecting member and a developer bearing member, wherein a remaining amount of developer in the process cartridge is successively detected by the main body of the electrophotographic image forming apparatus based on detection information from the first detecting member and the second detecting member.

8. A developing device for use in an electrophotographic image forming apparatus, the developing device comprising:

(a) a developer container for containing a developer, including:

a first detecting member which is an electrode member having a pair of input-side and output-side electrodes formed in parallel and in one plane at a predetermined interval for detecting the capacitance between the electrodes and which has a measurement-side electrode that is in contact with the developer and a reference electrode that is out of contact with the developer;

a developer removing member for removing any developer adhering to a detection region of the first detecting member; and a second detecting member formed of a conductive material for detecting the capacitance between the second detecting member and a developer bearing member; and (b) a developer bearing member for developing an electrostatic latent image formed on an electrophotographic photosensitive member by using the developer contained in the developer container, wherein an amount of developer in the developer container is detected.

9. In a developer amount detecting system for detecting an amount of developer in a developer container for containing the developer, developer amount detecting means comprising:

(a) a first detecting member which is an electrode member having a pair of input-side and output-side electrodes formed in parallel and in one plane at a predetermined interval for detecting the capacitance between the electrodes and which has a measurement-side electrode that is in contact with the developer and a reference electrode that is out of contact with the developer;

(b) a developer removing member for removing any developer adhering to a detection region of the first detecting member;

(c) a second detecting member consisting of a conductive member for detecting the capacitance between the second detecting member and a developer bearing member;

(d) means for converting developer amount detection information to the amount of developer in the developer container; and (e) means for indicating a detected amount of developer, or communicating means for transmitting the detected amount of developer to indicating means, wherein the amount of developer partway from a start of use of the developer container is detected by the first detecting member, and then the amount of developer is detected by the second detecting member.

10. An electrophotographic image forming apparatus for forming an image on a recording medium, comprising:

(a) an electrophotographic photosensitive member;

(b) a developer container for containing a developer and supplying the developer to a developer bearing member;

(c) electrostatic latent image forming means for forming an electrostatic latent image on the electrophotographic photosensitive member;

(d) a first detecting member which is an electrode member having a pair of input-side and output-side electrodes formed in parallel and in one plane at a predetermined interval for detecting the capacitance between the electrodes and which has a measurement-side electrode that is in contact with the developer and a reference electrode that is out of contact with the developer;

(e) a developer removing member for removing any developer adhering to a detection region of the first detecting member;

(f) a second detecting member consisting of a conductive member for detecting the capacitance between the second detecting member and a developer bearing member;

(g) means for converting developer amount detection information to an amount of developer in the developer container; and (h) means for indicating a detected amount of developer, or communicating means for transmitting the detected amount of developer to indicating means, wherein the amount of developer in the developer container is detected.

11. A process cartridge which is detachably mountable to a main body of an electrophotographic image forming apparatus, the process cartridge comprising:

(a) an electrophotographic photosensitive member;

(b) developing means for developing an electrostatic latent image formed on the electrophotographic photosensitive member;

(c) a developer container for containing a developer;

(d) a first detecting member which is an electrode member having a pair of input-side and output-side electrodes formed in parallel and in one plane at a predetermined interval for detecting the capacitance between the electrodes and which has a measurement-side electrode that is in contact with the developer and a reference electrode that is out of contact with the developer;

(e) a developer removing member for removing any developer adhering to a detection region of the first detecting member;

(f) a second detecting member consisting of a conductive member for detecting the capacitance between the second detecting member and a developer bearing member;

(g) means for converting developer amount detection information to an amount of developer in the developer container; and (h) means for indicating a detected amount of developer, or communicating means for transmitting the detected amount of developer to indicating means, wherein the amount of developer in the process cartridge is detected.

12. A developing device for use in an electrophotographic image forming apparatus, the developing device comprising:

(a) a developer container for containing a developer;

(b) a developer bearing member for developing an electrostatic latent image formed on an electrophotographic photosensitive member by using the developer contained in the developer container;

(c) a first detecting member which is an electrode member having a pair of input-side and output-side electrodes formed in parallel and in one plane at a predetermined interval for detecting the capacitance between the electrodes and which has a measurement-side electrode that is in contact with the developer and a reference electrode that is out of contact with the developer;

(d) a developer removing member for removing any developer adhering to a detection region of the first detecting member;

(e) a second detecting member consisting of a conductive member for detecting the capacitance between the second detecting member and a developer bearing member;

(f) means for converting developer amount detection information to an amount of developer in the developer container; and (g) means for indicating a detected amount of developer, or communicating means for transmitting the detected amount of developer to indicating means, wherein the amount of developer in the developer container is detected.

13. A process cartridge which is detachably mountable to a main body of an electrophotographic image forming apparatus, the process cartridge comprising:

(a) an electrophotographic photosensitive member;

(b) a developing member for developing an electrostatic latent image formed on the electrophotographic photosensitive member;

(c) a developer containing portion for containing developer to be used to develop the electrostatic latent image formed on the electrophotographic photosensitive member;

(d) a first detecting member including a first capacitance generating portion which is provided at a position where the first capacitance generating portion comes into contact with the developer contained in the developer containing portion when a predetermined amount of developer is contained in the developer containing portion for generating a capacitance corresponding to an amount of developer when a voltage is applied to the first capacitance generating portion, and a second capacitance generating portion which is provided at a position where the second capacitance generating portion is out of contact with the developer contained in the developer containing portion for generating a reference capacitance when a voltage is applied to the second capacitance generating portion to thereby detect the amount of developer contained in the developer containing portion by the main body of the electrophotographic image forming apparatus, with the process cartridge being mounted to the main body of the electrophotographic image forming apparatus;

(e) a second detecting member which is conductive and which is opposed to the developing member;

(f) a first electric contact for transmitting to the main body of the electrophotographic image forming apparatus a first electric signal corresponding to the capacitance generated when the voltage is applied to the first capacitance generating portion from the main body of the electrophotographic image forming apparatus, with the process cartridge being mounted to the main body of the electrophotographic image forming apparatus, and a second electric signal corresponding to the capacitance generated when the voltage is applied to the second capacitance generating portion from the main body of the electrophotographic image forming apparatus; and (g) a second electric contact which generates a third electric signal corresponding to a capacitance between the developing member and the second detecting member when a voltage is applied to the developing member.

14. A process cartridge according to claim 13, wherein the first detecting member is arranged upstream of the second detecting member in a developer supplying direction in which the developer contained in the developer containing portion is supplied toward the portion where the developing member is provided.

15. A process cartridge according to claim 13, further comprising a developer removing member for scraping off any developer adhering to a surface of the first detecting member.

16. A process cartridge according to claim 13, 14 or 15, wherein the first electric contact includes a first electric contact portion for transmitting the first electric signal to the main body of the electrophotgraphic image forming apparatus and a second electric contact portion for transmitting the second electric signal to the main body of the electrophotgraphic image forming apparatus, and wherein the first electric contact portion and the second electric contact portion are exposed through a cartridge frame.

17. An electrophotographic image forming apparatus to which a process cartridge is detachably mountable for forming an image on a recording medium, the electrophotographic image forming apparatus comprising:

(a) mounting means for detachably mounting the process cartridge, the process cartridge including:

an electrophotographic photosensitive member;

a developing member for developing an electrostatic latent image formed on the electrophotographic photosensitive member;

a developer containing portion for containing developer to be used to develop the electrostatic latent image formed on the electrophotographic photosensitive member;

a first detecting member including a first capacitance generating portion which is provided at a position where the first capacitance generating portion comes into contact with the developer contained in the developer containing portion when a predetermined amount of developer is contained in the developer containing portion for generating a capacitance corresponding to an amount of developer when a voltage is applied to the first capacitance generating portion, and a second capacitance generating portion which is provided at a position where the second capacitance generating portion is out of contact with the developer contained in the developer containing portion for generating a reference capacitance when a voltage is applied to the second capacitance generating portion to thereby detect the amount of developer contained in the developer containing portion by a main body of the electrophotographic image forming apparatus, with the process cartridge being mounted to the main body of the electrophotographic image forming apparatus;

a second detecting member which is conductive and which is opposed to the developing member;

a first electric contact for transmitting to the main body of the electrophotographic image forming apparatus a first electric signal corresponding to the capacitance generated when the voltage is applied to the first capacitance generating portion from the main body of the electrophotographic image forming apparatus, with the process cartridge being mounted to the main body of the electrophotographic image forming apparatus, and a second electric signal corresponding to the capacitance generated when the voltage is applied to the second capacitance generating portion from the main body of the electrophotographic image forming apparatus; and a second electric contact which generates a third electric signal corresponding to the capacitance between the developing member and the second detecting member when a voltage is applied to the developing member; and (b) indicating means for successively indicating a remaining amount of developer of the process cartridge in accordance with the electric signals from the first electric contact and the second electric contact of the process cartridge mounted to the mounting means.

* * * * *

UNITED STATES PATENT AND TRADEMARK OFFICE

CERTIFICATE OF CORRECTION

PATENT NO. : 6,535,699 B1
DATED : March 18, 2003
INVENTOR(S) : Daisuke Abe et al.

It is certified that error appears in the above-identified patent and that said Letters Patent is hereby corrected as shown below:

Title page,
Item [57], ABSTRACT,
Lines 5 and 12, “detecting capacitance” should read -- detecting the capacitance --.

Column 1,
Line 32, “process cartridge” should read -- process-cartridge --.
Line 47, “developer” should read -- developer-amount --.
Line 48, “amount” should be deleted.
Lines 49 and 53, “developer detecting electrode” should read -- developer-detecting-electrode --.

Column 2,
Lines 6, 12, 18, 26 and 33, “developer amount” should read -- developer-amount --.
Line 46, “detect” should read -- detect the --.

Column 4,
Line 51, “are” should read -- is --.
Line 52, “solenoid,” should read -- a solenoid, --.

Column 6,
Line 8, “between” should read -- between the --.

Column 8,
Line 24, “discrepancies. By” should read -- discrepancies. ¶ By --.
Line 35, “developer” should read -- developer-amount --.
Line 36, “amount” should be deleted.
Line 39, “developer amount” should read -- developer-amount --.

Column 9,
Line 56, “developer regulating member” should read
-- developer-regulating-member --.

Column 10,
Line 31, “developing bias output” should read -- developing-bias-output --.

Column 13,
Line 41, “detecting a” should read -- detecting the --.

UNITED STATES PATENT AND TRADEMARK OFFICE

CERTIFICATE OF CORRECTION

PATENT NO. : 6,535,699 B1
DATED : March 18, 2003
INVENTOR(S) : Daisuke Abe et al.

It is certified that error appears in the above-identified patent and that said Letters Patent is hereby corrected as shown below:

Column 14,
Line 1, “wherein a” should read -- wherein the --.
Line 30, “wherein an” should read -- wherein the --.
Line 53, “indicating a” should read -- indicating the --.

Column 15,
Line 19, “to an” should read -- to the --.
Lines 21 and 53, “indicating a” should read -- indicating the --.
Line 51, “to an” should read -- to the --.

Column 16,
Line 14, “to an” should read -- to the --.
Line 16, “indicating a” should read -- indicating the --.
Line 39, “an” should read -- the --.
Lines 57 and 62, “electric” should read -- electrial --.

Column 17,
Lines 2, 18 and 21, “electric” should read -- electrical --.

Column 18,
Line 3, “an” should read -- the --.
Lines 21, 27 and 39, “electric” should read -- electrical --.
Line 32, “elec-” should read -- electrical --.
Line 33, “tric” should be deleted.
Line 37, “a” should read -- the --.

Signed and Sealed this

Second Day of December, 2003

JAMES E. ROGAN
*Director of the United States Patent and Trademark Office*